United States Patent [19]

Mariani

[11] 4,005,567

[45] Feb. 1, 1977

[54] DEVICE FOR SECURING THE TAIL END OF YARN BOBBINS

[75] Inventor: Giuseppe Mariani, Milan, Italy

[73] Assignee: Snia Viscosa Societa' Nazionale Applicazioni Viscosa S.p.A., Milan, Italy

[22] Filed: Oct. 16, 1975

[21] Appl. No.: 623,004

[30] Foreign Application Priority Data

Oct. 25, 1974 Italy ..... 28791/74

[52] U.S. Cl. ..... 57/34 TT; 242/18 EW; 242/125.2

[51] Int. Cl.[2] ..... D01H 1/38

[58] Field of Search ..... 242/125.1, 125, 125.2, 242/18 PW, 18 EW; 57/34 TT, 131

[56] References Cited

UNITED STATES PATENTS

| | | | |
|---|---|---|---|
| 3,160,356 | 12/1964 | Fisher et al. | 242/18 PW |
| 3,283,489 | 11/1966 | Bakker | 57/34 TT |
| 3,677,492 | 7/1972 | Ueda | 242/18 PW |

*Primary Examiner*—George F. Mautz
*Attorney, Agent, or Firm*—Wenderoth, Lind & Ponack

[57] ABSTRACT

A method and a device for securing the tail end of yarn bobbins to the outer surface, of a tube by means of a tongue element, a portion of which is secured to the tube surface, while a portion of the tongue is maintained free. During the bobbin winding, a cup-shaped guard component encircles the tube surface part carrying the tongue, at a distance from the tube surface so dimensioned to allow the tongue free end or portion to maintain a desired operative position.

7 Claims, 7 Drawing Figures

18
10'
10
L 12
14
D'
30
H
10
D"
H' ≥ H
22
20

14
16
24
C
F
28
26
V
12
10'
30
10
20
V

16
C
12
14
10'
30
10
F
20

D"
22
20
24
12
14
D'
VII
10'
30

14
12
32
10'
30
10

24
10'
14
32
12
10
22
30
20

DEVICE FOR SECURING THE TAIL END OF YARN BOBBINS

BACKGROUND OF THE INVENTION

1. Field of the Invention.

This invention relates to the field of textile technology and in particular to the formation of bobbins (usually termed "cops") wherein threads and yarns are wound, usually on yarn drawing-twisting machines, about a tubular body, namely a metal tube coated with a thermoplastic resin, the bobbin having on one tube end thereof previously formed yarn coils projecting out of the yarn winding and forming a so called "transferring tail."

More specifically, this invention relates to a method and a device for securing the end of the transferring tail to the bobbin tube, in such a manner that such end be firmly retained after the bobbin or cop is removed from the winding spindle and stored, conveyed or manipulated, until its thread or yarn is used. The method and device according to this invention are particularly significant and interesting when a wholly automatic production cycle is followed, and specifically when the winding equipment comprises automatic devices to take-off and transport the wound cops without any manual intervention.

2. Description of the Prior Art.

Since in such cases the operations of wound bobbin removal, cutting or tearing-off the yarn at the end of the transferring tail and securing the tail end to a tube free portion cannot be manually performed, different methods have been proposed in order to prearrange the tube for tail end securing and yarn tearing-off, due to the same cop withdrawal and removal motion. The most widely known methods comprise the previous application of a flexible tongue or tab to one tube end, a portion of the tongue being caused to adhesively adhere to the tube surface, while a not adhering tongue portion is slightly lifted from the surface to allow the transferring tail end to become engaged thereunder and against the tube surface, in a sufficiently firm manner to ensure a resistance allowing the yarn to be torn off directly beyond the securing or engaging point, during the cop removal, while retaining the tail end in place. However, the tongue or tab (usually made of a suitably strong and resilient paper, plastics or the like) should be easily removable by hand, for subsequent yarn utilization, without appreciably damaging the tube coating surface.

As is well known, many limitations and drawbacks are encountered in using such systems. One of such limitations is due to the fact that the tongue adhesion should meet the conflicting requirements to ensure a firm yarn adhesion or securing when in use, and simultaneously to make easy the removal thereof. A further drawback consists in that, particularly in case of a relatively slow removal of the wound cop from the spindle, a tongue delamination and detachment action is exerted by the yarn progressively engaging thereunder and at the interface between the tongue and tube surface.

However, probably the greatest drawback of these known systems consists in that the tongue or tab, as previously applied to the tube, should maintain itself in place, under the conditions as required for a ready engagement of the yarn below its free or not adhesively connected portion, during the entire time (that may amount even to many hours) required for the completion of winding, while the tube is driven at a very high speed, of the order of many thousands RPM (i.e. at the speed of modern winding frames). Under the combined action of the very high rotary speed and of the resistance encountered by the tongue contacting air, the tongue is bent outwardly and sometimes its free end portion extends opposite to the direction required for yarn engagement. Such drawback may be at least partly avoided by winding a few yarn turns (which will not form the transferring tail) about the tongue. However, this results in another heavy drawback, in that due to the fact that the tongue is then kept firmly pressed across its whole length against the surface of the tube, the free portion of the tongue cannot in that separate into the spread apart position required to ensure a ready engagement of the yarn thereunder. Even with tongues of a particularly strong material, having a quick elastic reaction and a particular shape of their contour (i.e. highly expensive and not easily applied tongues), the known systems fail to ensure that no operational problems are encountered, with a consequent failure to secure the transfer tail. Obviously, the above represents a heavy drawback particularly in wholly automatized plants, since it leads to rejects, to the necessity of testing each wound cop, and so on.

Complementarily, a number of drawbacks also arise when using adhesives for initially securing the tongue to the tube surface. Thus, e.g., a given setting time is required by such adhesives to ensure a firm connection. Further, adhesive degradation may occur under the combined action of centrifugal force and ventilation, with the consequent decrease or even annulment of strength of the adhesive. Generally speaking, the adhesives are not very suitable for use on plastics surfaces, and when a physical-chemical attack is used to ensure the required bond, the subsequent tearing-off of the tongue results in an inadmissible damage to the plastics tube surface.

SUMMARY OF THE INVENTION

An object of this invention is to provide a method and a device adapted to avoid or at least greatly reduce the above stated and further drawbacks, resulting from the use of prior art systems, as well as to ensure a smooth course of all yarn winding, tail end securing and yarn breaking operations, together with an easy removal of the securing means, by solving the different, previously considered conflicting problems.

A further object of this invention is to provide a method and a device for securing retaining means to the surface of tube plastics coatings, so to obtain a high shear resistance (i.e. a resistance to the action exerted on the retaining means by the yarn that is being broken, directly below the retained tail) and simultaneously a low tensile strength, when the retaining means is to be successively removed, with a practically negligible alteration of the tube plastics surface.

According to this invention, the method essentially comprises the steps of: providing a tongue in the form of a sheet or strip of an essentially flexible laminar material (as e.g. a suitably thick and/or suitably processed paper, a plastics foil and the like); applying such tongue at the required position on the tube coating, near one tube end, in such a manner that at least one tongue end portion does not adhere to the tube; fitting the tube on the winding frame spindle in such a manner that the tube end carrying the tongue gets is positioned within a recess of a component associated with the spindle and forming about the same an annular intervening space having a radial width sufficient to allow the tongue free portion to detach from the tube, under the combined action of centrifugal force and air flow as resulting from quick rotation, well as to spread apart therefrom only by an amount strictly necessary for the introduction and engagement of the yarn transferring tail end, in order to retain the same; and forming the coils of the transferring tail, and then of the whole winding, starting from a level above the tongue.

In order to carry-out the method, a device is provided comprising, in combination, a tongue (actually a series of tongues and thus a series of tubes, each having a tongue partly secured to one end thereof), and the component associated with the spindle and in the form of a cup-shaped pulley with an upwardly directed cavity and an inside diameter larger, by only a few millimeters' than the tube outside diameter, in order to form the intervening space containing the tongue, such that the amount of spreading of the free portion of the tongue is controlled during the formation of the tail end, as well as of the whole cop winding.

In order to achieve the above mentioned further object of the invention, for securing a tongue portion to the tube plastics coating or sheath, a small amount of a thermoplastic material compatible with that of the coating is applied hot to the tube and is thereby locally welded therewith, thus forming thereon a head or thickened portion, partly overlapping the tongue, for securing the same to the tube.

DESCRIPTION OF THE PREFERRED EMBODIMENTS

Figures 1, 2, 3, 4, 5, 6, 7:
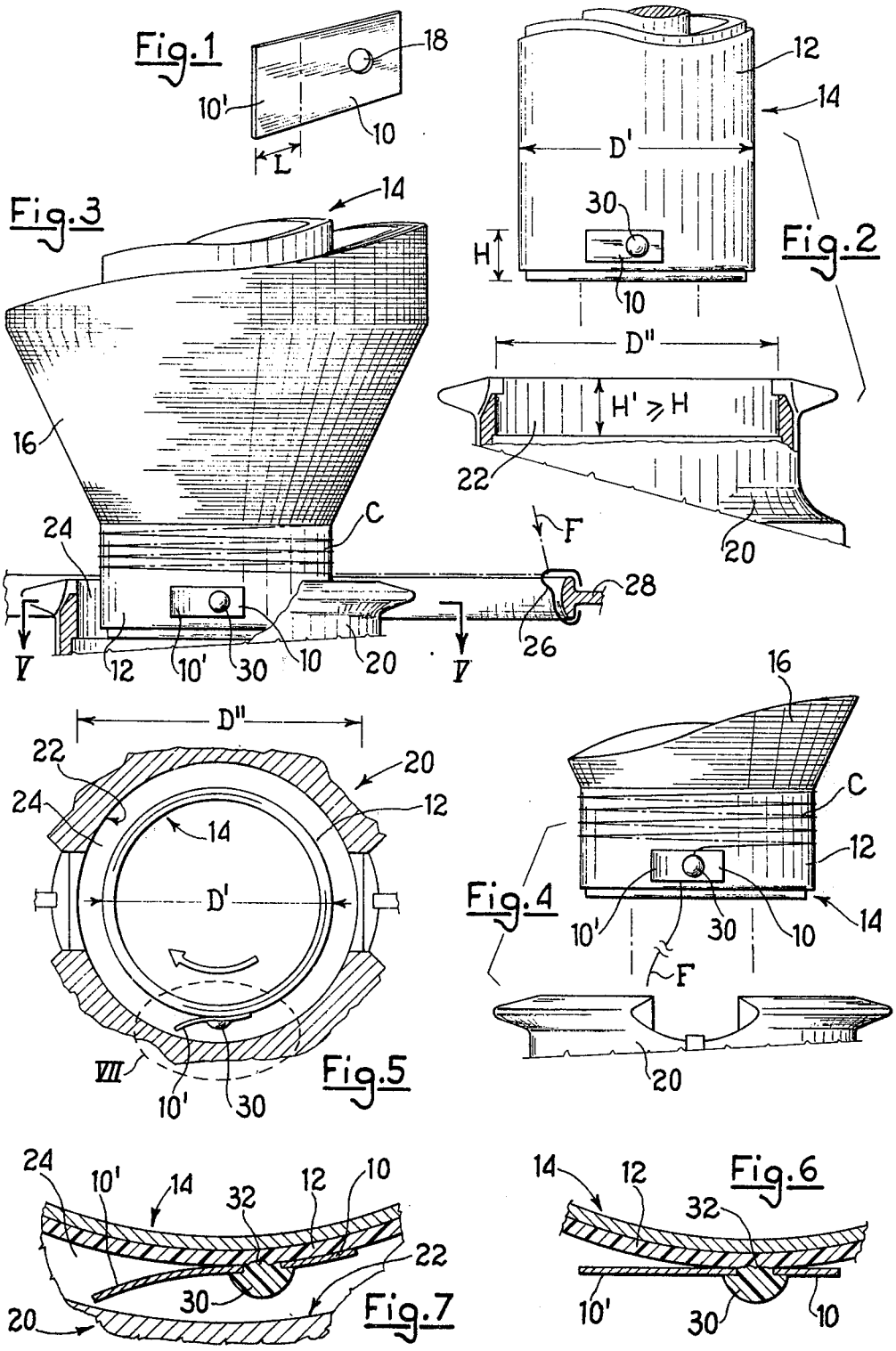
FIG. 1 is an enlarged perspective view of a preferred embodiment of a retaining tongue, before its application and use.
FIGS. 2, 3 and 4 are partial sectional views (wherein numerous parts and components, as e.g. the spindle, not directly correlated with the invention, have been omitted) of a tube with a tongue applied thereto, along with a cup-shaped component wherein the tube is partly housed, the tube and component being shown before, during and after the winding formation, respectively, until to cop removal and breaking of the yarn directly below the yarn tail end.
FIG. 5 is a fragmentary cross-section of the components, taken along line V—V of FIG. 3.
FIG. 6 is a highly enlarged fragmentary cross-section of a tongue secured to a tube by a preferred method according to this invention.
FIG. 7 is an also highly enlarged view of the detail shown by the dash line VII of FIG. 5.

In order to carry-out the invention, a number of tongues must be provided. Each of the tongues actually consists of a small element 10, e.g. but not necessarily having a rectangular shape, made of paper or other similar suitable material (not forming a feature of the invention) that must be sufficiently strong and flexible, as well as suitable to be partly secured to the surface of a plastic coating or sheath 12 of a conventional tube 14, whereon a yarn winding 16 is to be formed. The term "partly secured" is to be understood to mean that at least a tongue portion 10', having a length L (see FIG. 1) sufficient for engaging thereunder the transferring tail end, is not secured to the tube surface and can be spread apart therefrom, thus forming a small wedge-shaped opening, wherein the tail end can be introduced and firmly engaged.

In a preferred method of forming and securing the tongue, as will be discussed below, the element 10 has a narrow through hole 18 (FIG. 1). The tongue is secured adjacent one tube end according to a conventional technique and the tube portion bearing the tongue has a pre-established small height H (see FIG. 2) from the adjacent tube end.

The equipment for winding a bobbin or cop (usually comprising a spindle and related supporting and driving means, a plurality of which is associated e.g. with a drawing and twisting machine, or with any other yarn collecting means) includes a component 20, actually consisting of a small pulley, fitted at a spindle lower end and having an upwardly directed cavity 22, the inside diameter D'' of which is larger than the tube outer diameter D' in order to form therebetween an annular intervening space 24 (see FIGS. 3, 5 and 7) having a width, e.g. from 2 to 5 millimeters, sufficient to ensure the attainment of the effects and conditions to be specified below.

Moreover, the depth H' of cavity 22 should be equal to, or greater than the height H of the tube portion bearing tongue 10.

The tube lower end is introduced into cavity 22 while the tube is positioned on the spindle, before winding a cop 16, and then it is possible to avoid: (a) the formation (in an already known manner) of a transferring tail C (see FIG. 3) which is wound around tongue 10, and accordingly the tongue free portion 10' is free to spread apart from the tube; (b) the strong resistance of the air during the very rapid rotation of the spindle (the air present in the intervening space is also caused to rotate, at least for the most part thereof), and (c) an overbending of tongue free portion 10', which is spread apart from the tube due to centrifugal force, as it can be bent outwardly only by the amount allowed by the radial size of intervening space 24, since it rests against the side wall of the cavity. An example of the maximum spreading apart position that can be taken by the tongue free portion is shown in FIGS. 5 and 7.

The formation of a cop 16 can be performed in any conventional manner. A non restrictive example of such formation in conventional equipment of the so called "ring" type, wherein the yarn F is fed through a guide 26 slidingly fitted about a ring 28, is shown in FIG. 3.

Accordingly, in spite of the high spindle RPM and of the long time required for winding, the tongue free portion 10', when taking the position of maximum but controlled spreading apart, is compelled to maintain this position until the end of cop winding. Such condition is determined by suitably dimensioning the tongue free portion 10', as well as the intervening space width, to be the most suitable for the insertion and engagement of the end of transferring tail C under the tongue during lifting and removal of the cop from the spindle, as exemplified in FIG. 4, with consequent breaking of the underlying yarn portion.

The above described invention can be advantageously carried-out by securing the tongue 10 to the tube end by a method that will be described with reference to FIGS. 1 and 6. According to such method, the tongue is placed onto the surface of the tube plastic sheath 12 and a small amount of a molten thermoplastic adhesive (such as so called "hot melt") compatible with the composition of plastic sheath 12, is then applied through the hole 18. Such amount must be sufficient to form a small head 30 outside the tongue, while the tiny shank 32 which is formed within the hole 18 is weldingly connected with the surface of tube sheath 12.

It has been ascertained that such a connection can be very quickly performed, due to a practically instantaneous solidification of the thermoplastic adhesive, and exhibits a high shearing resistance, i.e. a resistance against the action which is exerted by the yarn which lies under the tongue free portion 10' and which is tensile stressed until it breaks, even when yarns having high tensile strength (as e.g. polyamide, polyester and like yarns) and higher counts (within the limits of usual productions) are processed.

It has been also ascertained that the shearing resistant connection simultaneously exhibits a relatively low tensile strength, such that the short shank 32 may be readily separated from the surface of the tube sheath 12, and such that this separation results in only a practically unnoticeable tube surface alteration, which is at any rate limited to the small area defined by the hole 18.

Therefore, such advantageous method for securing the tongue to the tube, apart from ensuring an absolutely consistent and safe engagement of the transferring tail to the tube and a likewise safe yarn breakage when the cop is automatically removed from the spindle, also allows for easily removing; the tongue from the tube, without requiring any unusual physical effort and without any practical damage to the tube surface.

The provision of hole 18 in the tongue or element 10 is a preferred, but not an exclusive embodiment of the method for securing the tongue to the tube, since it allows a steady and safe fastening in the most suitable position, such as to ensure that the tongue portion 10' is properly proportioned and positioned to define, along with the underlying surface of sheath 12, the wedge shaped space whereinto the yarn can be safely engaged and retained.

However, different but equivalent procedures can be followed. E.g. two or more holes may be provided in suitable tongue positions. Notches through which the molten thermoplastic adhesive is applied may be formed instead of the hole or holes, and the adhesive may also be applied in one or more points of tongue contour, thereby forming a readily hardened projection, overlapping a tongue edge portion, and so on.

Moreover, the breaking operation of the yarn portion exceeding the tail C may be ensured by complementary means adapted to replace or to assist the same. E.g., a preferably but not necessarily automatic cop removal from the spindle may be supplemented by a cutting action, f.i. by a movable blade which is brought against the yarn for cutting the same, or the yarn can be broken by a localized melting action, as obtained by a synchronized motion of an overheated wire or other similar means, adapted to locally apply heat to a desired yarn position.

It is to be understood that various modifications and changes may be made to the previously described, specific technical solutions, to better meet different requirements of the application and operation of the device, without departing from the spirit and scope of this invention.

I claim:

1. In a thread or yarn winding system of the type including a rotating bobbin tube onto which thread or yarn is wound to form a thread or yarn cop, wherein after formation of the cop said tube and cop are withdrawn from a spindle to form a thread or yarn transfer tail, and means for grasping and retaining said transfer tail; the improvement wherein said grasping and retaining means comprises:

at least one flexible plate-shaped member attached to the outer surface of said tube adjacent one end thereof and extending substantially circumferentially thereof, said plate-shaped member having a first portion secured to said outer surface of said tube, said plate-shaped member having at least one circumferentially endwise second portion free of attachment to said outer surface of said tube;

a thermoplastic coating covering at least that portion of said outer surface of said tube to which said first portion of said plate-shaped member is attached;

thermoplastic attachment means melted into and secured to said thermoplastic coating for attaching said first portion of said plate-shaped member to said outer surface of said tube;

said plate-shaped member having a flexibility such that upon rotation of said tube said second portion of said plate-shaped member bends and separates from said outer surface of said tube due to centrifugal force, whereby said transfer tail may be engaged between said second portion of said plate-shaped member and said outer surface of said tube; and a cup-shaped element having a cavity into which said one end of said tube and said plate-shaped member extend during the formation of said cop, said cavity being defined by an inner surface spaced from said outer surface of said tube by a distance to form means for limiting the amount of separation of said second portion of said plate-shaped member from said outer surface of said tube and for preventing said second portion from bending circumferentially backwardly over said first portion of said plate-shaped member.

2. The improvement claimed in claim 1, wherein the connection between said attachment means and said thermoplastic coating has a high shear strength but a low tensile strength.

3. The improvement claimed in claim 1, wherein said attachment means comprises at least one projection extending outwardly from said thermoplastic coating and overlapping at least a portion of said first portion of said plate-shaped member.

4. The improvement claimed in claim 3, wherein said first portion of said plate-shaped member has at least one hole therethrough, said projection extending through said hole and overlapping the edge thereof.

5. The improvement claimed in claim 1, wherein said plate-shaped member is formed of flexible plastic material.

6. The improvement claimed in claim 1, wherein said distance equals from 2 to 5 mm.

7. The improvement claimed in claim 1, wherein the depth of said cavity is at least equal to the axial distance from said one end of said tube to the edge of said plate-shaped member furthest spaced from said one end.

* * * * *